United States Patent [19]

Jager

[11] 4,357,873

[45] Nov. 9, 1982

[54] APPARATUS FOR DESTROYING STRUCTURES SUCH AS CONCRETE WALLS

[75] Inventor: Ernst H. Jager, Schrobenhausen, Fed. Rep. of Germany

[73] Assignee: Messerschmitt-Bölkow-Blohm GmbH, Fed. Rep. of Germany

[21] Appl. No.: 231,802

[22] Filed: Feb. 5, 1981

Related U.S. Application Data

[62] Division of Ser. No. 117,097, Jan. 31, 1980.

[30] Foreign Application Priority Data

Feb. 6, 1979 [DE] Fed. Rep. of Germany ..... 2904338

[51] Int. Cl.[3] ..... F42B 1/02

[52] U.S. Cl. ..... 102/310; 102/320

[58] Field of Search ..... 102/305, 311, 320, 308, 102/310

[56] References Cited

U.S. PATENT DOCUMENTS 3,999,483 12/1976 Grundy ..... 102/23

OTHER PUBLICATIONS

Explosives & Demolitions, War Dept., Tech. Manual, #FM5-25, May, 1945, pp. 102-109.

*Primary Examiner*—Peter A. Nelson

*Attorney, Agent, or Firm*—McGlew and Tuttle

[57] ABSTRACT

A device for destroying structures such as concrete walls comprises first and second plates each including at least a portion of explosive material which are mounted on respective sides of the structure to be exploded, preferably in alignment. Each pair of explosive plates is exploded substantially simultaneously or in short succession in order to destroy the wall portion therebetween. Because of the detonation of both of the explosive plates, the structure therebetween will be disintegrated without fragments being catapulted away in a hazardous manner. With the inventive method, the plates are positioned on respective opposite sides of the structure in opposing relationship and the plates are exploded so as to generate shock waves which extend inwardly toward the structure therebetween.

3 Claims, 1 Drawing Figure

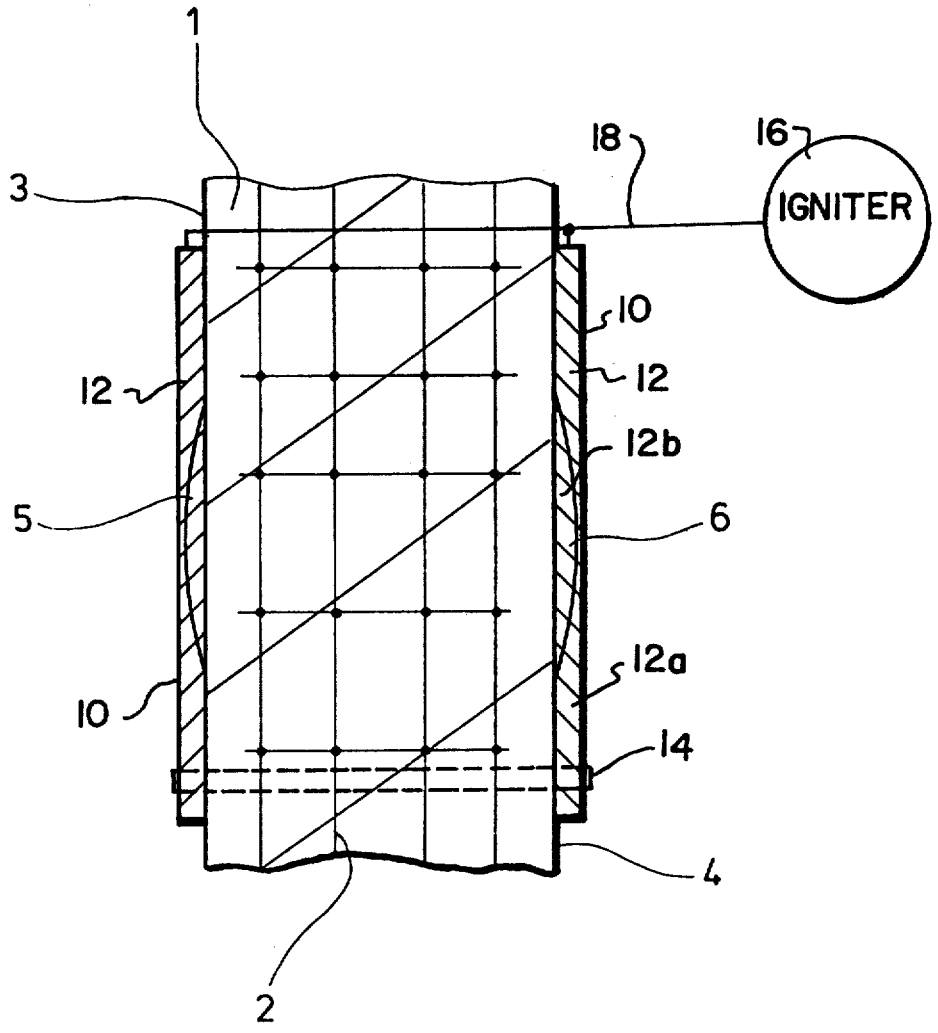
1
3
18
16
IGNITER
10
12
12
12b
5
6
12a
10
14
4
2

APPARATUS FOR DESTROYING STRUCTURES SUCH AS CONCRETE WALLS

This is a division of application Ser. No. 117,097, filed Jan. 31, 1980.

FIELD AND BACKGROUND OF THE INVENTION

This invention relates in general to devices for demolishing structures and in particular to a new and useful device and method for destroying structures such as concrete walls.

The invention relates to a device for destroying concrete walls and structures of similar materials by blasting action. The invention is to be applied primarily to concrete walls strongly reinforced with steel and wire mesh, particularly of reactor structures, which are to be destroyed with relatively small hazards to the ambience.

According to German AS No. 26 01 237, it is known to provide metal pipelines to be laid in waters or swamps with a concrete shell preventing them, while empty, from being driven up by buoyancy. Such a concrete shell also provides protection against mechanical and chemical action. On the other hand, such coatings are disadvantageous insofar as great difficulties arise as soon as they are to be locally removed for wanted repairs or subsequent embedding of reinforcements. This must be done, according to the above cited German AS by blasting off the concrete coating at the respective locations by means of collars of explosives applied to the circumference of the line, without damaging the exposed pipe portions.

SUMMARY OF THE INVENTION

The present invention departs from the prior art both in purpose and provided means.

The invention is directed to an explosive destruction primarily of all kinds of reinforced concrete walls, or similar structures, in an energy economizing manner and without unfavorably affecting or endangering the ambience, and in a way permitting an expedient removal or cleaning up.

In accordance with the invention a device for destroying structures such as a concrete wall comprises one or more pairs of plates each of which include at least a portion thereof with explosive material. The plates are held in the vicinity of each side of the structure by clamping elements such as securing belts, bolts etc. and they are connected to one or more ignitors so that they may be exploded in a timed sequence. The ignitors for example, may explode them substantially simultaneously or with a selected time delay.

Because of the detonation of both of the explosive plates, the concrete wall is disintegrated, without fragments being catapulted away in a hazardous manner. This is particularly due to the fact that the shock waves caused by the two simultaneous or consecutive detonations on both sides travel into the interior of the material or the concrete wall where they collide at a location predetermined mainly by the time delay between the ignitions of the two explosive layers, and are then reflected at the free surfaces of the wall as rarefaction waves. With a correct rating of the two explosive layers as to the kind of explosive size and thickness, or dimensioning of the detonating power or initiated pressure and velocity relative to the thickness and strength of the concrete wall, the tensile strength of the concrete, which is very low as compared to its compressive strength, will be exceeded by the rarefaction waves, and the concrete wall will separate into fragments and thereby expose the reinforcement. The fragments thus produced are then relatively easily removable and transportable and the reinforcement may be cut up to pieces by cutting mechanism and without major expenses.

If very thick walls of concrete housings or structures, such as pressure housings of nuclear reactors or military fortifications, are involved, a plurality of operations in accordance with the invention may be provided, i.e. explosive plates may be applied repeatedly in succession to disintegrate a portion of a concrete wall. The wall portion is thus destroyed in steps and it may initially be weakened (made frangible) by a heavy first detonation and then disintegrated by means of one or more plate pairs of lower or stepped intensity.

The invention also covers the possibility of providing plates of unequal explosive power on either side, rated for the prevalent static stresses in, or the structure of, the concrete wall. While selecting the blast plates with regard to their blasting properties and power, it is advisable to take into account the disposition of the reinforcement of the concrete wall. For example, in supporting concrete dome structures, the reinforcement is provided in the external zone of tensile stresses, so that the blasting powers of the outer and inner plates can appropriately be proportioned to control the concentration of the detonation waves and to obtain optimum results.

Accordingly, it is an object of the invention to provide a device for destroying structures such as a concrete wall which comprises two or more pairs of plates or sheets each including at least a portion of explosive material and means for holding the plates in the vicinity of each side of the structure to be destroyed and ignitor means associated with the plates for exploding them in a selected period of time.

A further object of the invention is to provide a method for destroying a structure which comprises positioning a plate having at least a portion of an explosive material on each side of the structure and exploding the plates in a selected sequence.

A further object of the invention is to provide a device for destroying a structure such as a concrete wall which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic representation of a structure partly in section showing a device for destroying the structure in accordance with the invention.

DESCRIPTION OF THE PREFERRED EMBODIMENT

Referring to the drawing, in particular, the invention embodied therein comprises a device for destroying structures such as a concrete wall generally designated 1 which in the example illustrated has a reinforcement 2 therein which, for example, may be metal or a similar type reinforcement.

Shown is a concrete wall 1 with a reinforcement 2. To both a side 3 and a side 4 of the wall 2, a large surface blasting plate 5 and 6 respectively, forming a pair, is applied and the two plates of this pair are detonated simultaneously or in short succession to destroy the wall portion therebetween.

The plates 5 and 6 may also comprise a casing 10 holding the explosive charge 12, and they be made of any size or shape in accordance with the structure to be demolished.

If, for example, concrete domes of housing structures (reactor housings), i.e. curved concrete walls, are to be disintegrated, it may be advantageous to provide a larger surface extension of an outer layer of explosive 12*a* as compared to an inner layer 12*b* of explosive which, with a smaller surface extension, is applied to the surface that has the smaller radius of the curvature.

Means such as straps 14 or bolts (not shown) or simply adhesive tape are applied to the plates 5 and 6 in order to hold them to the structure 2. The plates 5 and 6 are held in the vicinity of each side of the structure or directly against the face in accordance with experiments developed during the demolishing of similar structures. Ignitor means such as a fusing device 16 connected through electrical or other lines 18 to each plate 5 and 6 are provided for exploding the plates or the explosive charge portion thereof in a selected time sequence which may be simultaneously or with one following the other at a selected time delay.

While a specific embodiment of the invention has been shown and described in detail to illustrate the application of the principles of the invention, it will be understood that the invention may be embodied otherwise without departing from such principles.

I claim:

1. A device for destroying a reinforced concrete wall having a particular thickness and opposite side surfaces comprising:

a first plate engaged over and covering an area of one side surface which area has dimensions that are large with respect to a thickness of said first plate;

a second plate engaged over and covering an area of the other side surface which area has dimensions that are large with respect to a thickness of said second plate, said areas of the one and other side surfaces aligned with each other across the thickness of the wall; each of said first and second plates including at least a portion made of explosive material facing said areas respectively;

holding means for holding said first and second plates firmly against said areas respectively; and ignition means connected to the explosive material of said first and second plates for successively igniting the explosive material of said first and second plates, said successive igniting occurring within a time period shorter than the time required for a shock wave produced by an explosion of the explosive material of one of said first and second plates to traverse the particular wall thickness whereby the explosive material of said first and second plates are ignited and exploded to produce shock waves in the wall which meet each other within the wall.

2. A device according to claim 1 wherein first and second plates have different quantities of explosive material so that they have different blasting power.

3. A device according to claim 1 wherein said plates include portions having explosives of different characteristics and different orientations.

* * * * *